US010273913B2

(12) United States Patent
Tuttle

(10) Patent No.: US 10,273,913 B2
(45) Date of Patent: Apr. 30, 2019

(54) MULTI-MODE THERMOACOUSTIC ACTUATOR

(71) Applicant: The United States of America, as represented by the Secretary of the Navy, Washington, DC (US)

(72) Inventor: Steven G. Tuttle, Brandywine, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 32 days.

(21) Appl. No.: 15/605,547

(22) Filed: May 25, 2017

(65) Prior Publication Data

US 2018/0340494 A1 Nov. 29, 2018

(51) Int. Cl.

| | |
|---|---|
| ***F02M 27/08*** | (2006.01) |
| ***F23B 30/00*** | (2006.01) |
| ***F23R 3/28*** | (2006.01) |
| ***F23R 3/42*** | (2006.01) |
| ***F23D 14/02*** | (2006.01) |
| ***F23D 14/70*** | (2006.01) |
| ***F23M 20/00*** | (2014.01) |

(52) U.S. Cl.

CPC ..... *F02M 27/08* (2013.01); *F23B 7/002* (2013.01); *F23D 14/02* (2013.01); *F23D 14/70* (2013.01); *F23M 20/005* (2015.01); *F23R 3/286* (2013.01); *F23R 3/42* (2013.01); *F23D 2203/1023* (2013.01); *F23G 2202/703* (2013.01); *F23R 2900/00013* (2013.01)

(58) Field of Classification Search

CPC . F02M 27/08; F23R 3/43; F23B 7/002; F23D 14/62

USPC ..... 431/9, 354, 202; 60/226.1

See application file for complete search history.

(56) References Cited

U.S. PATENT DOCUMENTS

| | | | |
|---|---|---|---|
| 4,168,348 | A | 9/1979 | Bhangu et al. |
| 4,408,461 | A | 10/1983 | Bruhwiler et al. |
| 4,926,963 | A | 5/1990 | Snyder |

(Continued)

FOREIGN PATENT DOCUMENTS

| | | | |
|---|---|---|---|
| WO | WO 2009088193 A2 * | 7/2009 | ..... A61N 5/06 |
| WO | WO 2016-134068 A1 | 8/2016 | |

OTHER PUBLICATIONS

Bolt, J. A., Holkeboer, D. H., and Mirsky, W., An Investigation on the Effects of Ultrasonic Energy on Combustion, The University of Michigan, Ann Arbor, 1958.

(Continued)

*Primary Examiner* — Gregory L Huson
*Assistant Examiner* — Nikhil Mashruwala
(74) *Attorney, Agent, or Firm* — US Naval Research Laboratory; William P. Ladd

(57) ABSTRACT

A combustor including a first perforated layer including a first opening having a first diameter, wherein the first opening is configured to receive a flow of fluid including a fuel and air mixture; and impart a first rotational instability to the flow of fluid that is dependent on the first diameter; and a second perforated layer surrounding a combustion area, wherein the second perforated later includes a second opening having a second diameter, and wherein the second layer is located between the first layer and the combustion area.

10 Claims, 4 Drawing Sheets

(56) References Cited

U.S. PATENT DOCUMENTS

| | | | | |
|---|---|---|---|---|
| 8,931,588 | B2 * | 1/2015 | Murray | F02K 3/06 181/214 |
| 9,003,760 | B2 * | 4/2015 | Chelin | B64D 15/04 137/15.1 |
| 9,546,602 | B2 * | 1/2017 | Julliard | B64D 33/06 |
| 9,845,728 | B2 * | 12/2017 | Brown | F02C 7/04 |
| 2007/0298361 | A1 * | 12/2007 | Fogliani | F23D 14/02 431/354 |
| 2008/0131828 | A1 * | 6/2008 | Ojiro | F23D 14/14 431/350 |
| 2009/0184604 | A1 * | 7/2009 | Symko | F02G 1/043 310/334 |
| 2011/0126544 | A1 * | 6/2011 | Foster | F02K 1/822 60/752 |
| 2014/0162197 | A1 | 6/2014 | Krichtafovitch et al. | |
| 2016/0010864 | A1 * | 1/2016 | Abe | F23R 3/286 60/748 |
| 2018/0029054 | A1 | 2/2018 | Jiang | |
| 2018/0135515 | A1 * | 5/2018 | Fung | F02C 7/045 |

OTHER PUBLICATIONS

Lee, S., Kim, J., and Kim, H., An experimental study on the structural alteration of C3H8-air premixed flame affected by ultrasonic standing waves of various frequencies, J Mech Sci Technol, 29(3), pp. 917-922, 2015.

Tuttle, S., Hinnant, K., Loegel, T., Fisher, B., Tuesta, A., Weismiller, M., Development of a Low-Emission Spray Combuster for Emulsified Crude Oil, U.S. Naval Research Laboratory Memorandum Report, pp. 1-121, 2017.

Jiang, L. and Argawal, A., Investigation of Glycerol Atomization in the Near-Field of a Flow-Blurring Injector using Time-Resolved PIV and High-Speed Visualization, Flow, Turbulence and Combustion, vol. 94, No. 2, 2015.

Jiang, L., Agrawal, A., and Taylor, R., Clean combustion of different liquid fuels using a novel injection, Experimental Thermal and Fluid Science, vol. 57, pp. 275-284, 2014.

Jiang, L. and Agrawal, A., Combustion of straight glycerol with/without methane using a fuel-flexible, low-emissions burner, Fuel vol. 136, pp. 177-184, 2014.

Jiang, L. and Agrawal, A., Spray features in the near field of a flow-blurring injector investigated by high-speed visualization and time-resolved PIV, Exp Fluids, vol. 56:103, pp. 1-13.

Tuttle, S., Farley, J. and Fleming, J., Efficient Atomizations and Combustion of Emulsified Crude Oil, U.S. Naval Research Laboratory Memorandum Report, pp. 1-37, 2014.

International Search Report for PCT/US2018/034708 from the International Searching Authority, dated May 25, 2017.

Written Opinion for PCT/US2018/034708 from the International Searching Authority, dated Sep. 19, 2018.

* cited by examiner

MULTI-MODE THERMOACOUSTIC ACTUATOR

GOVERNMENT INTEREST

The embodiments herein were made by employees of the United States Government and may be manufactured, used, and/or licensed by or for the United States Government without the payment of royalties thereon.

BACKGROUND

Technical Field

The embodiments herein generally relate to actuators, and more particularly to thermo-acoustic actuators.

Description of the Related Art

Ultrasonic waves may be used to provide flame enhancement in a combustor (also referred to as a burner, combustion chamber, or flame holder) of an engine. Flame enhancement in the combustor is desirable because it results in higher produced power and higher efficiency of the engine.

Conventionally, piezoelectric transducers may be used to provide ultrasonic waves. Piezoelectric transducers are typically constructed of doped, solid-state quartz. However, their electromechanical properties generally change with temperature, making their operation and control difficult without an additional temperature monitoring and control system.

Piezoelectric transducers also typically need to be actively cooled. However, a cooling process creates local cold spots in or around the combustor, and may quench combustion and potentially requires more energy than the ultrasonic waves would add to the process. Furthermore, the delivered frequencies of solid-state quartz can change with temperature, and high temperature typically negatively impacts their durability. Moreover, conventional piezoelectric transducers often produce ultrasound at less than only five frequencies, and usually not even concurrently.

Further, temperature gradients within solid-state quartz can cause stress and fracture during operation in an engine. Also, piezoelectric transducers tend to require external, electric stimulation. The associated structural and electronic support architecture, such as a fixture to hold the actuator, connection wires, and driving circuitry can add complexity and critical weight to an engine, which is not desirable.

Accordingly, piezoelectric transducers may not be practical for installation into the high temperature environments found in combustors. An alternative method is to use small speakers to generate ultrasonic waves. However, the small speakers that produce ultrasound are conventionally constructed of thin, flexible plastic membranes and copper wire, which could either burn or melt in a high temperature engine combustor.

SUMMARY

In view of the foregoing, an embodiment herein provides a combustor comprising a first perforated layer comprising a first opening having a first diameter, wherein the first opening is configured to receive a flow of fluid comprising a fuel and air mixture; and impart a first rotational instability to the flow of fluid that is dependent on the first diameter; and a second perforated layer surrounding a combustion area, wherein the second perforated later comprises a second opening having a second diameter, and wherein the second layer is located between the first layer and the combustion area.

The second opening may be configured to impart a second rotational instability to the flow that is dependent on the second diameter of the second opening; an offset distance between a first axis of the first opening and a second axis of the second opening; and a distance between the first and second perforated layers.

The second opening may be configured to generate an acoustic signal based on the first and second rotational instabilities on the flow of fluid. The second opening may be configured to generate a flame using the flow of fluid in the combustion area. The second opening may be configured to increase a speed of the flame in the combustion area using the acoustic signal. The combustor may further comprise a filter configured to filter a plurality of harmonics from the acoustic signal, wherein the filter may be operationally coupled to any of the first and second perforated layers.

An embodiment herein provides a method for increasing an efficiency of an engine, the method comprising receiving a flow of fluid comprising a fuel and air mixture through a first opening in a first perforated layer of a combustor of the engine; creating a first rotational instability to the flow of fluid, wherein the first rotational instability is dependent on a first diameter of the first opening; and positioning a second perforated layer between the first layer and a combustion area of the combustor, wherein the second layer comprises a second opening.

The method may further comprise creating, using the second opening, a second rotational instability to the flow of fluid that is dependent on a second diameter of the second opening; an offset distance between a first axis of the first opening and a second axis of the second opening; and a distance between the first and second perforated layers.

The method may further comprise generating, using the second opening, an acoustic signal based on the first and second rotational instabilities on the flow of fluid. The method may further comprise generating a flame using the second opening and the flow of fluid in the combustion area. The method may further comprise increasing a speed of the flame in the combustion area using the acoustic signal. The method may further comprise filtering a plurality of harmonics from the acoustic signal.

An embodiment herein provides for a combustor comprising a plurality of perforated surrounding layers, comprising a first perforated surrounding layer comprising a first opening, wherein the first opening is configured to receive a flow of fuel and air mixture; and impart a first rotational instability to the flow, wherein the first rotational instability is dependent on a first diameter of the first opening; and a second perforated surrounding layer comprising a second opening, wherein the second layer is located between the first layer and a combustion area; and a plurality of intermediate perforated surrounding layers, located between the first and second layers, wherein each of the intermediate layers comprise a corresponding intermediate plurality of openings configured to pass the flow and impart a plurality of intermediate rotational instabilities to the flow.

The second opening may be configured to impart a second rotational instability to the flow, wherein the second rotational instability is dependent on a first offset distance between a first axis of the first opening and an intermediate axis of an intermediate opening of an intermediate layer of the plurality of intermediate layers; a second offset distance between the intermediate axis and a second axis of the second opening; a second diameter of the second opening;

an intermediate diameter of the intermediate opening; a first distance between the first and the intermediate layer; and a second distance between the intermediate layer and the second layer.

The second opening may be configured to generate an acoustic signal based on the first, second, and the plurality of intermediate rotational instabilities on the flow. The second opening may be configured to generate a flame using the flow in the combustion area. The second opening may be configured to increase a speed of the flame in the combustion area using the acoustic signal. The combustor may further comprise a filter configured to filter out a plurality of harmonics of the acoustic signal.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1:
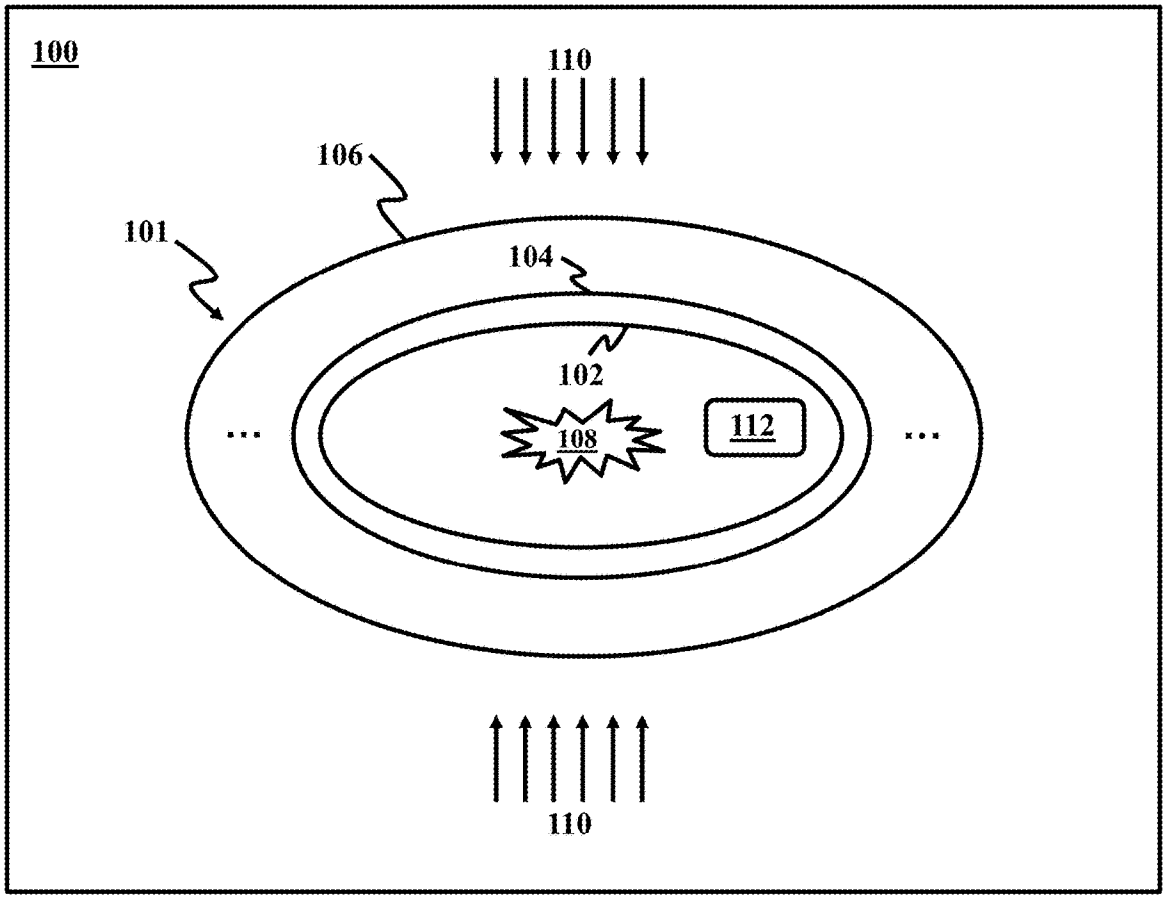
FIG. 1 is a schematic diagram illustrating an engine combustor according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein provide a multi-mode thermo-acoustic actuator that passively uses the air flow and fuel vapor which is already present in a combustor, to produce range discrete acoustic waves that enhance the combustion. An embodiment herein provides for producing an acoustic tone composed of discrete acoustic harmonics, with frequencies above the ultrasonic limit of 22 kHz.

Referring now to the drawings, and more particularly to FIGS. 1 through 4, where similar reference characters denote corresponding features consistently throughout the figures, there are shown preferred embodiments.

FIG. 1 is a schematic diagram illustrating an engine 100 according to an embodiment herein. The engine 100 may include a combustor 101. The combustor 101 may include multiple perforated surrounding layers, for example perforated surrounding layers 102, 104, and 106 that surround a combustion area 108. In the embodiments herein, the surrounding layers 102, 104, and 106 may comprise any of a metal and an alloy. In FIG. 1 three layers 102, 104, and 106 are shown; however, the combustor 101 may include any number of intermediate perforated layers between the innermost layer 102 and outermost layer 106. In some cases, the combustor 101 can include no intermediate layers (i.e., intermediate layer 104 can be excluded from the combuster 101 shown in FIG. 1).

In an embodiment herein, a flow of fuel and air mixture 110 enters the combustion area 108 through the perforated layers 102, 104, and 106. In an embodiment herein, openings (illustrated in FIG. 2 and further discussed below) in the perforated layers 102, 104, and 106 are positioned such that the flow of fuel and air mixture 110 creates acoustic waves as it enters the combustion chamber 108. In an embodiment herein, the combustor 101 may include a filter 112 to filter the acoustic waves created in the combustion area 108. In an embodiment herein, the filter 112 may be an acoustic filter, for example a muffler.

Figure 2:
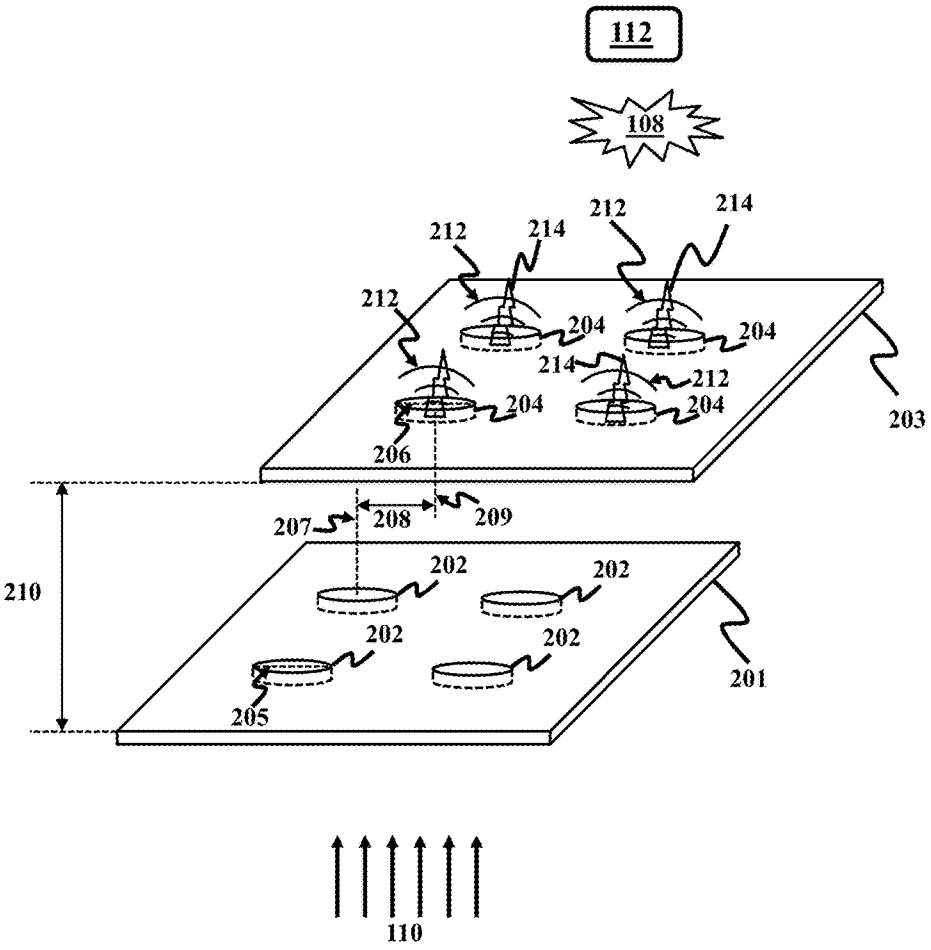
FIG. 2 is a schematic diagram illustrating two perforated surrounding layers of a combustor according to an embodiment herein.

FIG. 2, with reference to FIG. 1, is a schematic diagram illustrating two perforated layers 201 and 203, according to an embodiment herein. The perforated layer 201 may include openings 202, and the perforated layer 203 may include openings 204. As the flow of fuel and air mixture 110 flows through the openings 202 and 204 of the perforated layers 201 and 203, acoustic waves 212 are created from the openings 204. If the perforated layer 203 is adjacent to the combustion chamber 108, the acoustic waves 212 control the intensity of flames 214 created by combusting the fuel and air mixture 110.

As the fuel and air mixture 110 passes through the perforated layers 201 and 203, each of the openings 202 and 204 imparts rotational instability to the flow that contribute to creating the acoustic waves 212. The embodiments herein further provide for tuning the acoustic waves 212 by changing its frequency components. The frequency components of the acoustic waves 212 are determined by any of a diameter 205 of the openings 202, a diameter 206 of the openings 204, the offset distance 208 between the opening axes 207 and 209, and the spacing 210 between the layers 201 and 203.

When the fuel-air mixture 110 exits the layer 203 and combusts, the waves 212 cause the flames 214 to oscillate, which in turn produce pressure oscillations, or sound, at the corresponding frequencies. In an embodiment herein, the combustion of the fuel-air mixture 110 includes a chemical combination of the fuel and the oxygen components in the fuel-air mixture 110. The chemical combination may include production of heat and light and cause combustion of the fuel-air mixture 110. The acoustic waves 212 improve combustion by further increasing flame speed which increases combustion stability and increases combustor heat release. Consequently, the combustor 101 can be built smaller and lighter without sacrificing generated power. The acoustic waves 212 may further break down diffusion gradients at the interfaces between gases and surface to increase heat transfer, and also combustion exhaust mass transfer. Hence, the embodiments herein provide for increased efficiency of the combustor 101.

The acoustic waves 212 may further be tuned to provide noise cancelling interaction with other acoustic waves generated by the combustor 101, which may cause instability for combustion, or environmental sound, or air pollution. In an embodiment herein, the tuning of the acoustic waves 212 may be performed by changing its frequency components. As described above, the frequency components of the acoustic waves 212 may be determined by any of the diameter 205 of the openings 202, the diameter 206 of the openings 204, the offset distance 208 between the opening axes 207 and 209, and the spacing 210 between the layers 201 and 203. In an embodiment herein, the discrete frequencies in the acoustic waves 212 may be filtered, by a filter 112, to provide a single tone acoustic signal, or multiple specific discrete acoustic signals.

In an embodiment herein, in order to produce the desired acoustic tone and constituent frequencies of the acoustic waves 212, the fuel and air mixture 110 may be directed through any number of perforated layers similar to the prorated layers 201 and 203. The perforated layers 201 and 203 may have any number of openings 202 and 204, and the openings 202 and 204 may have any shape including any of circular, oval, rectangular, triangular, and polygon.

Figure 3:
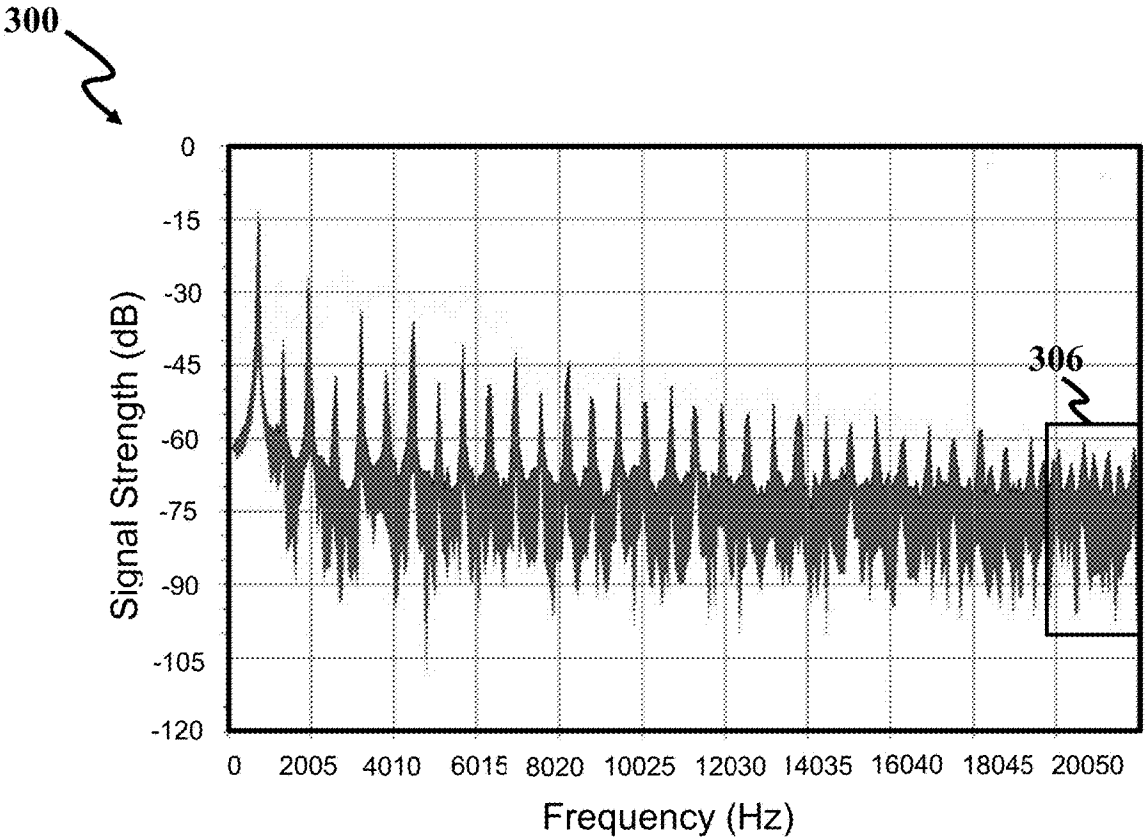
FIG. 3 is a graph illustrating acoustic spectra produced by the openings in the surrounding perforated layers of a combustor according to an embodiment herein.

FIG. 3, with reference to FIGS. 1 and 2, is a graph 300 illustrating strength of fundamental tones of different frequencies, according to an exemplary embodiment herein. Graph 300 is obtained by signal measurement in a test set up of the combustor 101 having three perforated layers 102, 104, and 106 with 1.6 mm-diameter openings. The graph 300 illustrates numerous harmonics extending toward ultrasonic frequencies (greater than 22 kHz, illustrated by box 306) in accordance with an exemplary embodiment herein.

Figure 4:
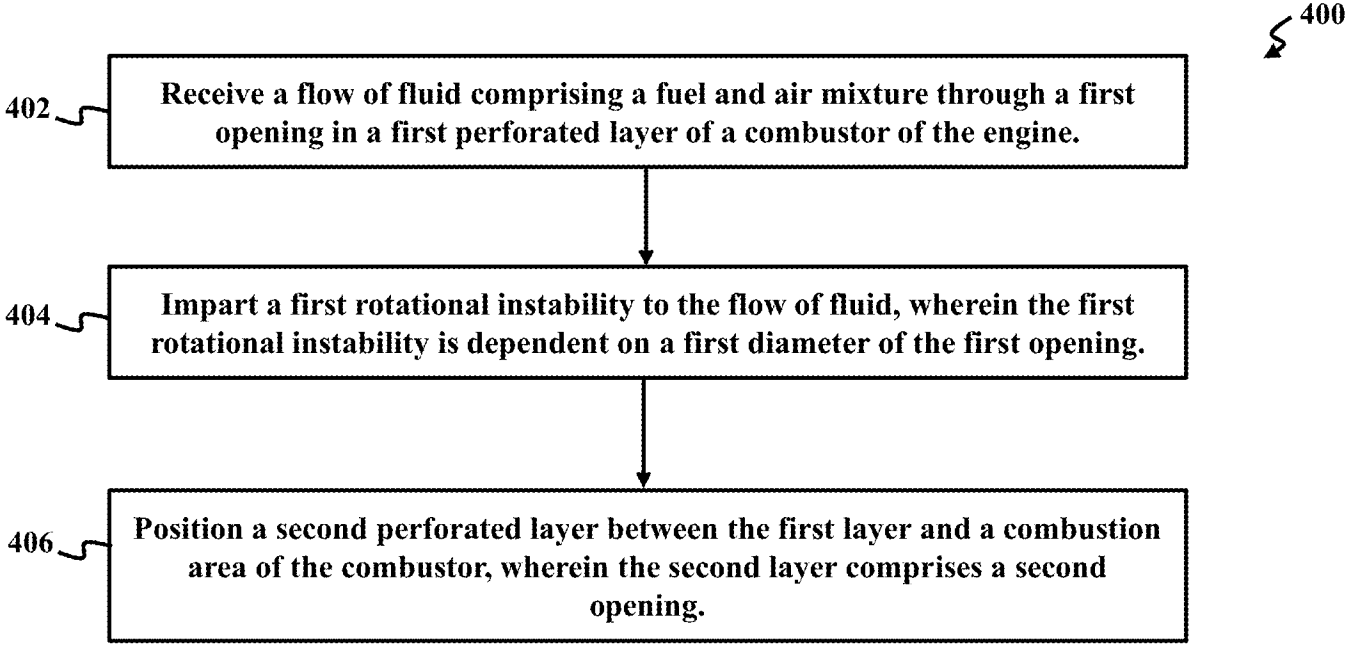
FIG. 4 is a flowchart illustrating a method for increasing an efficiency of an engine, according to an embodiment herein.

FIG. 4, with reference to FIGS. 1 through 3, is a flow diagram illustrating a method 400 for increasing an efficiency of an engine 100 according to an embodiment herein. At step 402, the method 400 receives a flow of fluid comprising a fuel and air mixture 110 through a first opening 202 in a first perforated layer 201 of a combustor 101 of the engine 100. At step 404, the method 400 imparts a first rotational instability to the flow of fluid, wherein the first rotational instability is dependent on a first diameter 205 of the first opening 202. At step 406, the method 400 may position a second perforated layer 203 between the first layer 201 and a combustion area 108 of the combustor 101, wherein the second layer 203 includes a second opening 204.

In an embodiment herein, the method 400 may include imparting, using the second opening 204, a second rotational instability to the flow of fluid 110 that is dependent on a second diameter 206 of the second opening 204, an offset distance 208 between a first axis 207 of the first opening 202 and a second axis 209 of the second opening 204, and a distance 210 between the first and second perforated layers 201 and 203. The method 400 may include generating, using the second opening 204, an acoustic signal based on the first and second rotational instabilities on the flow of fluid 110.

In some embodiments, additional perforated layers with openings can similarly be used by method 400 to impart further rotational instability on the flow of fluid 110. In this case, the acoustic signal can also be generated by method 400 based on the further rotational instability of the additional perforated layers.

In an embodiment herein, the method 400 may include generating a flame using the second opening 204 and the flow of fluid 110 in the combustion area 108. The method 400 may include increasing a speed of the flame in the combustion area 108 using the acoustic signal. The method 400 may include filtering a plurality of harmonics from the acoustic signal.

The techniques provided by the embodiments herein use the passive nature of a multi-mode thermos-acoustic actuator that allow for the formation of acoustic tones using high temperature flows, without the need of actuation by delicate ultrasonic transducers or speakers that need electronic circuitry to drive their operation. This will allow for the formation of flame enhancing sound without complex components and circuitry in a high temperature environment.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A combustor comprising:

a first perforated layer comprising a first opening having a first diameter, wherein the first opening is configured to:

receive a flow of fluid comprising a fuel and air mixture; and impart a first rotational instability to the flow of fluid that is dependent on the first diameter; and a second perforated layer surrounding a combustion area, wherein the second perforated layer comprises a second opening having a second diameter, and wherein the second layer is located between the first layer and the combustion area; and wherein the second opening is configured to impart a second rotational instability to the flow that is dependent on: the second diameter of the second opening; an offset distance between a first axis of the first opening and a second axis of the second opening; and a distance between the first and second perforated layers.

2. The combustor of claim 1, wherein the second opening is configured to generate an acoustic signal based on the first and second rotational instabilities on the flow of fluid.

3. The combustor of claim 2, wherein the second opening is configured to generate a flame using the flow of fluid in the combustion area.

4. The combustor of claim 3, wherein the second opening is configured to increase a speed of the flame in the combustion area using the acoustic signal.

5. The combustor of claim 3, further comprising a filter configured to filter a plurality of harmonics from the acoustic signal, wherein the filter is operationally coupled to any of the first and second perforated layers.

6. A method for increasing an efficiency of an engine, the method comprising:

receiving a flow of fluid comprising a fuel and air mixture through a first opening in a first perforated layer of a combustor of the engine;

imparting a first rotational instability to the flow of fluid, wherein the first rotational instability is dependent on a first diameter of the first opening;

positioning a second perforated layer between the first layer and a combustion area of the combustor, wherein the second layer comprises a second opening; and imparting, using the second opening, a second rotational instability to the flow of fluid that is dependent on: a second diameter of the second opening; an offset distance between a first axis of the first opening and a second axis of the second opening; and a distance between the first and second perforated layers.

7. The method of claim 6, further comprising generating, using the second opening, an acoustic signal based on the first and second rotational instabilities on the flow of fluid.

8. The method of claim 7, further comprising generating a flame using the second opening and the flow of fluid in the combustion area.

9. The method of claim 8, further comprising increasing a speed of the flame in the combustion area using the acoustic signal.

10. The method of claim 9, further comprising filtering a plurality of harmonics from the acoustic signal.

* * * * *